US006651567B2

(12) United States Patent
Takeichi et al.

(10) Patent No.: US 6,651,567 B2
(45) Date of Patent: Nov. 25, 2003

(54) RAILWAY CAR

(75) Inventors: Michifumi Takeichi, Yamaguchi (JP); Kazuhiro Makino, Yamaguchi (JP); Kentaro Masai, Yamaguchi (JP); Masaaki Shigeyama, Yamaguchi (JP); Daisuke Muto, Ibaraki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/945,688

(22) Filed: Sep. 5, 2001

(65) Prior Publication Data

US 2002/0029721 A1 Mar. 14, 2002

(30) Foreign Application Priority Data

Sep. 11, 2000 (JP) ..... 2000-280132
Sep. 11, 2000 (JP) ..... 2000-280133
Jun. 6, 2001 (JP) ..... 2001-171262

(51) Int. Cl.[7] ..... B60N 5/00
(52) U.S. Cl. ..... 105/329.1
(58) Field of Search ..... 105/396, 397, 105/329.1, 238.1, 413, 418

(56) References Cited

U.S. PATENT DOCUMENTS 2,925,050 A * 2/1960 Candlin, Jr. et al. ..... 105/397
2,946,297 A * 7/1960 Dean et al. ..... 105/345
3,794,374 A * 2/1974 Manning ..... 105/238.1
5,388,529 A * 2/1995 Tieberghien et al. ..... 105/397

* cited by examiner

*Primary Examiner*—S. Joseph Morano
*Assistant Examiner*—Robert J. McCarry, Jr.
(74) *Attorney, Agent, or Firm*—Antonelli, Terry, Stout & Kraus, LLP

(57) ABSTRACT

The floor of a passenger cabin in a railway car is mounted on a base plate 23 of an underframe 11 via plural common joists 33, 34. The vibration of the truck is transmitted via a center pin 27, a bolster 25, center sills, a base plate 23, and common joists 33, 34 to the floor 31, thereby vibrating the floor. Out of the common joists 33 and 34, the common joists 34 that are positioned near the width-direction-center of the car body do not extend beyond the center sill 25 toward the longitudinal end of the car body. This arrangement reduces the vibration of the floor 31 positioned at the longitudinal end portion of the car body.

13 Claims, 5 Drawing Sheets

RAILWAY CAR

FIELD OF THE INVENTION

The present invention relates to a railway car, and especially to reducing the noise in the passenger cabin of a railway car moving at a high speed.

Heretofore, the vibration of the passenger cabin is reduced by providing a rubber vibration isolator between the car body and the floor of the cabin, thereby reducing the noise generated within the body of the railway car. Further, a damping material is adhered to the car body to provide the same effect.

The structure of the car body will now be explained. The car body comprises an underframe, side framing, roof framing, and buffer beams positioned at the longitudinal ends of the body. The floor is mounted on plural common joists placed on the underframe. On the lower surface of the underframe is positioned a member for connecting the body to a truck or bogie. This member is positioned on a bolster mounted on the width direction of the underframe. Center sills are positioned in the front and back areas of the bolster. The rigidity of these beams is relatively high. Further, the rigidity of the underframe and the common joists is also relatively high. The vibration generated in the truck is transmitted to the connection member, the underframe, the common joists and the floor in this order by solid-state transmission, causing noise inside the passenger cabin. This vibration is generally between 100 to 300 Hz.

SUMMARY OF THE INVENTION

Studies of the solid-state transmission discovered that the vibration of the truck is transmitted to the underframe. The floor is fixed onto the underframe via common joists. The floor is fixed firmly onto the underframe via common joists. The rigidity of the underframe and the common joists is relatively high. Therefore, the noise generated within the passenger cabin is also high.

Especially, the connecting portion between the truck and the underframe has a relatively high rigidity due to the bolster and the center sill. The relation between the floor near the connecting portion and the underframe is similar to the relation between other members. Therefore, the noise from this connecting portion is relatively large.

The object of the present invention is to reduce the noise generated at the connecting portion between the car body and the truck.

In order to achieve the above object, the present invention provides a railway car comprising two side sills, a base plate positioned between said two side sills, a bolster positioned under said base plate between said two side sills, a center sill connected to said bolster, a plurality of common joists mounted above said base plate, and a floor of a passenger cabin mounted on said common joists, wherein the common joists are characterized in that in the longitudinal end portion of said car body beyond said bolster, the common joists exist at the width-direction-ends of said car body but no common joists exist in the center of width of said car body.

DETAILED DESCRIPTION OF PREFERRED EMBODIMENTS

Figure 1:
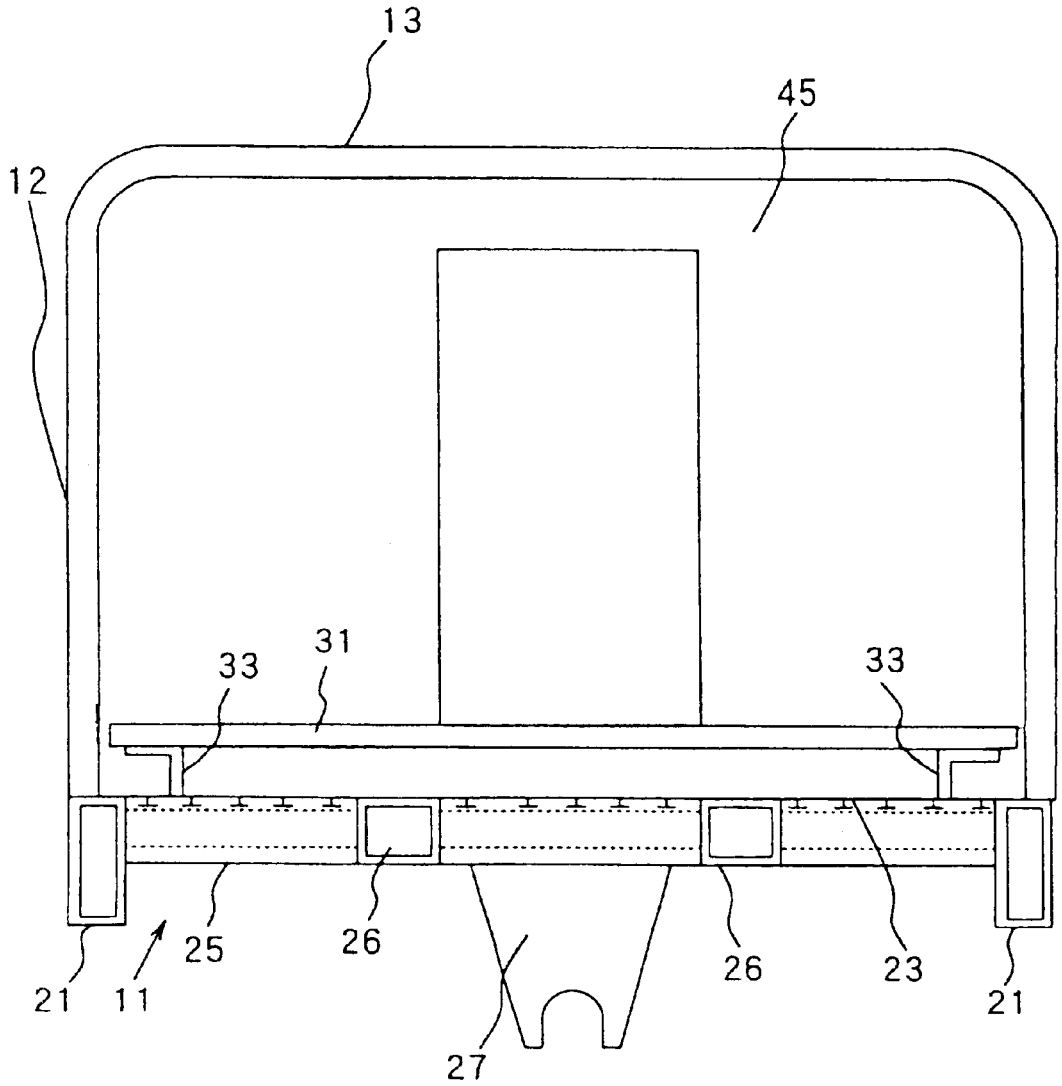
FIG. 1 is a vertical cross-sectional view taken along the width direction of the car body according to one embodiment of the present invention.
Figure 2:
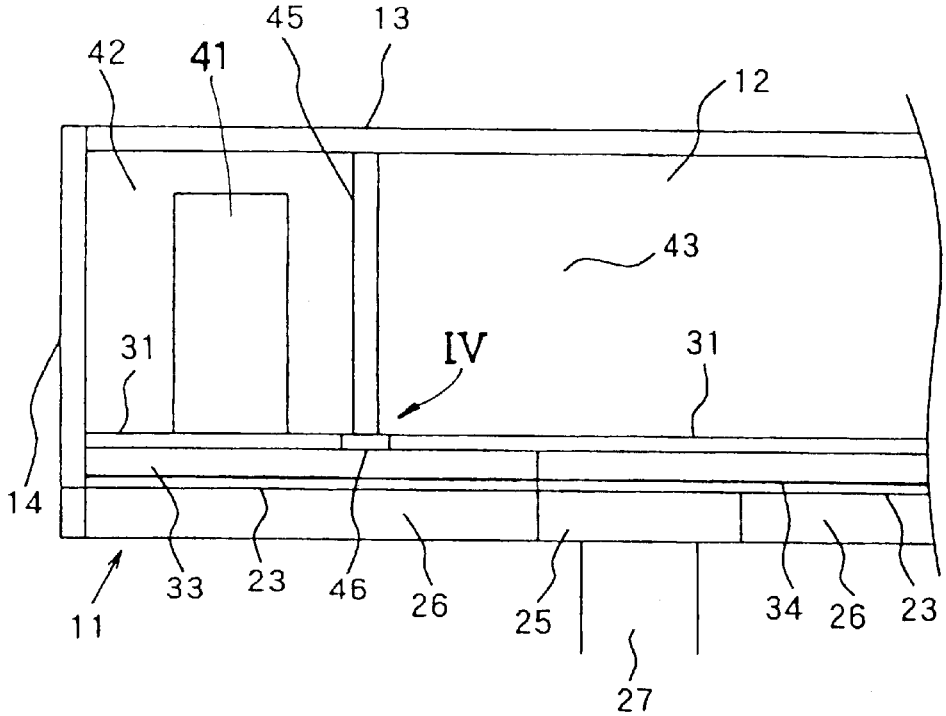
FIG. 2 is a vertical cross-sectional view taken at the center of FIG. 1.
Figure 3:
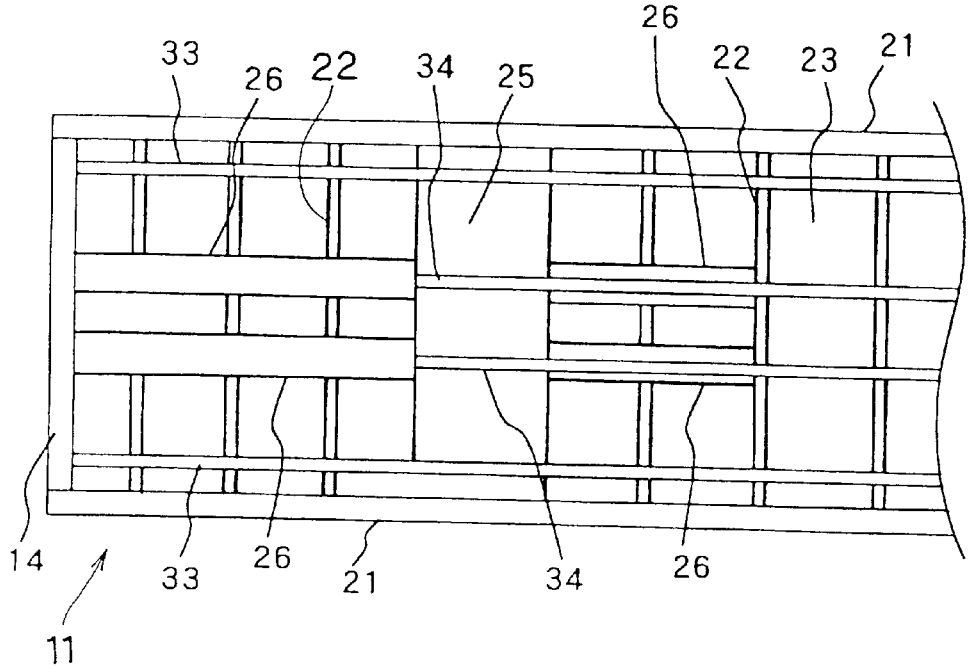
FIG. 3 is a plan view of the underframe of FIG. 1.

A preferred embodiment of the present invention will now be explained with reference to FIGS. 1 through 3. FIG. 3 is a plan view of the underframe, and cross beams 22, bolster 25 and center sills 26 are positioned below a base plate 23, so they should be shown in dotted lines, but in the present drawing, the base plate 23 is omitted. The base plate 23 is similarly omitted from the drawing in FIGS. 5, 6 and 8.

The car body comprises an underframe 11, a side framing 12, a roof framing 13, and buffer beams 14 positioned at the longitudinal end portions of the body. The underframe 11 comprises side sills 21, 21 which are positioned along the longitudinal direction of the car body on the width-direction-sides thereof, a plurality of cross bearers 22 that connect the two side sills, and a base plate 23 fixed above said cross bearers. The base plate 23 is formed of extruded members having ribs that protrude downward. These extruded members are aligned along the longitudinal direction of the car body and plural members are arranged in the width direction of the car body. These extruded members are joined together to form the base plate 23. The base plate 23 is a member that constitutes an airtight chamber. The rigidity of the underframe 11 is relatively high.

On the longitudinal end of the underframe 11 connected to the truck is a large bolster 25 positioned below the base plate 23 and along the width direction of the car body. The bolster 25 is connected to the cross beams 21. A center pin 27 is fixed to the lower surface of the bolster 25 for connecting the car body to the truck. Two rows of center sills 26 are positioned in front of and behind the bolster 25. The center sills 26 are positioned along the longitudinal direction of the car body. These are also relatively large. The rigidity of the bolster 25 and the center sills 26 are relatively higher compared to the base plate 23.

Common joists 33 and 34 for mounting the floor 31 of the passenger cabin 43 are arranged on the upper surface of the base plate 23. The common joists 33 and 34 are placed along the longitudinal direction of the car body. The two common joists 33 positioned near the width-direction-ends of the body have approximately the same length as the longitudinal length of the car body. The two center common joists 34 do not extend beyond the bolster 25 toward the longitudinal end of the body. The floor 31 at the end portion beyond the bolster 25 is supported by the two common joists 33 and has sufficient strength. The floor 31 toward the center area from the bolster 25 is fixed to four common joists 33 and 34.

The longitudinal ends of the car body beyond the bolster 25 are generally used as a passage 42 (generally called a platform) that is connected to a doorway 41 formed to the side of the car body. The platform 42 and the cabin 43 (the platform 42 can be considered as a part of the cabin 43) are divided by a partition board 45. The partition board 45 is mounted on and fixed to the frame member 46 on the floor. The frame member 46 is fixed to the common joists 33. Further, the partition board 45 is fixed to the side framing 12 and the roof framing 13. The floor 31 of the platform 42 and the floor 31 of the passenger cabin 43 are different members.

Figure 4:
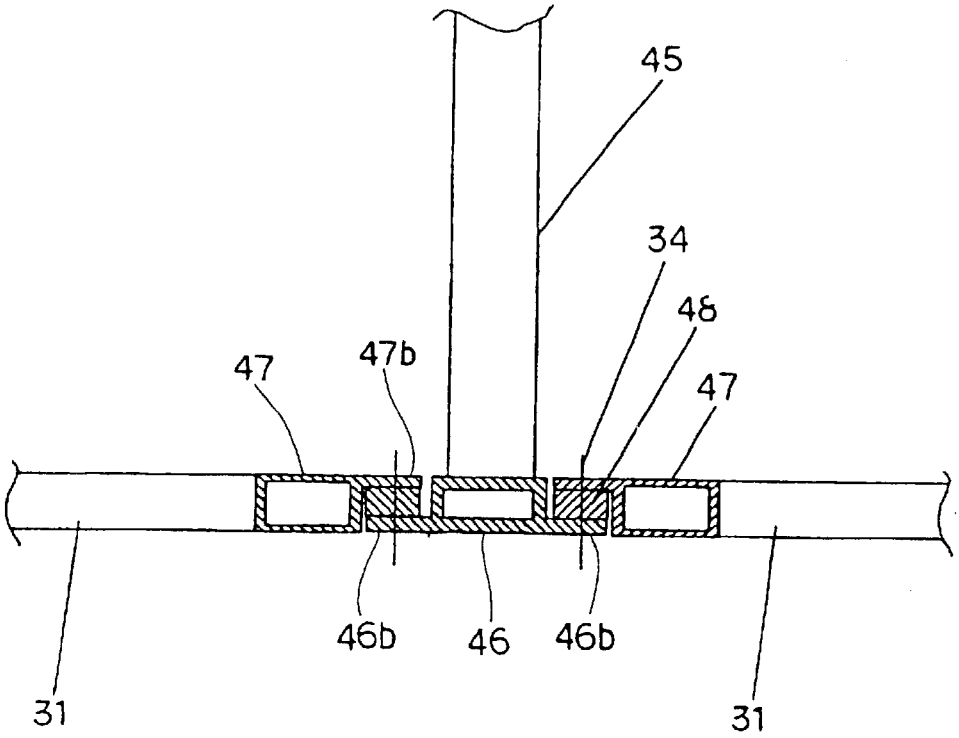
FIG. 4 is an enlarged cross-sectional view of area IV of FIG. 2.

The relation of the partition board 45 and the frame member 46 will now be explained. In FIG. 4, the frame member 46 under the partition wall 45 is mounted on common joists 33, 33. The frame member 46 is hollow, and flanges 46*b* are protruded in horizontal directions from both bottom sides thereof. Hollow rim members 47 are integrally formed to the longitudinal ends of the floor 31, 31. On the upper end of a rim member 47 is formed a flange 47*b* that protrudes in the horizontal direction. The flange 32*b* is mounted on the flange 46*b* via a buffer material 48. The three members are joined together by a joint member 34.

The underframe 11, the side framing 12, the roof framing 13, the buffer beams 14, the side sills 21, 21, the cross bearer 22, the base plate 23, the bolster 25, the center sill 26, the common joists 33, 34, the frame member 46, and the rim member 47 are formed of extruded members made of light alloy.

According to the present structure, the vibration energy transmitted from the truck via the center pin 27, the bolster 25, the center sill 26, the base plate 23, and the common joists 33 and 34 to the floor 31 of the passenger cabin or the platform 42 can be reduced. This is because the common joists 34 that are positioned close to the center pin 27 through which the vibration energy is mostly transmitted do not support the floor 31. Accordingly, the sound pressure released to the platform 42 and the passenger cabin by the vibration of the floor is reduced. Thus, the noise within the passenger cabin of the railway car is effectively reduced.

This is realized by removing the common joists 34 in front of and behind the bolster 25 to which the vibration energy is greatly converged. In other words, each common joist 34 is discontinued in the longitudinal direction. Therefore, the floor 31 without the common joists 34 is capable of isolating the vibration completely, thereby reducing the sound pressure released to the passenger cabin of the car body by the vibration of the floor 31 at that area.

Moreover, since the partition board 45 is mounted on the common joists 33 and 33 positioned at both ends rather than the floor 31, the vibration of the partition board 45 having a large area is reduced, which is also effective in cutting down the noise.

An air-conditioning duct is positioned between the base plate 23 and the floor 31. In general, the air-conditioning duct is positioned on the base plate 23, but it is better to position the duct on the floor 31. According to this arrangement, the rigidity of the floor is increased, and the vibration of the floor is reduced.

The embodiment of FIG. 5 will now be explained. The embodiment shown in FIGS. 1 through 4 used common joists 34, 34 that did not extend beyond the bolster 25 toward the end of the car body. The embodiment of FIG. 5 utilizes common joists 34, 34 that have predetermined areas on both sides of the bolster 25 removed. The predetermined area refers to the area where the vibration is great. This area is determined based on experiment. The common joists 34, 34 are positioned outward in the width-direction of the car body than the joint position of the center pin 27 and the bolster 25.

According to this arrangement, the vibration of the common joists 34, 34 are not transmitted in the area where the common joists 34, 34 are removed, and therefore the vibration does not reach the floor 31. The common joists 34, 34 are mounted on the bolster 25 but they are positioned outside the width-direction end of the center pin 27, so the vibration from the center pin 27 is not transmitted to the joists easily.

Figure 5:
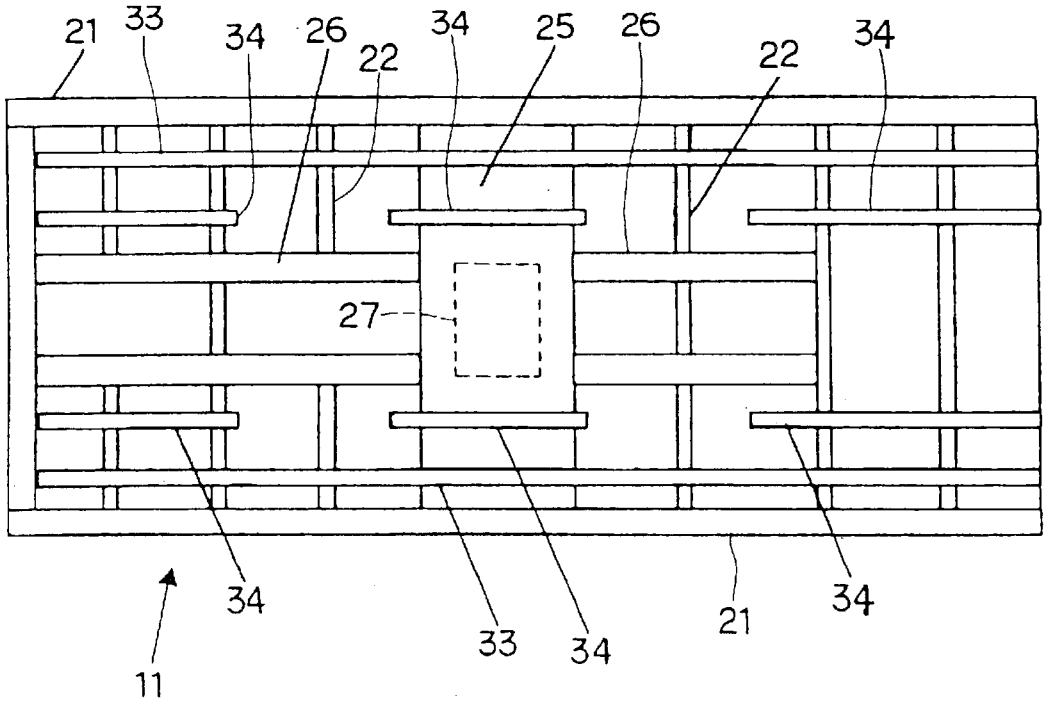
FIG. 5 is a plan view of the underframe according to another embodiment of the present invention.

In the embodiment of FIG. 5, the common joists 34, 34 positioned on the car-end side beyond the bolster 25 can be removed.

Figure 6:
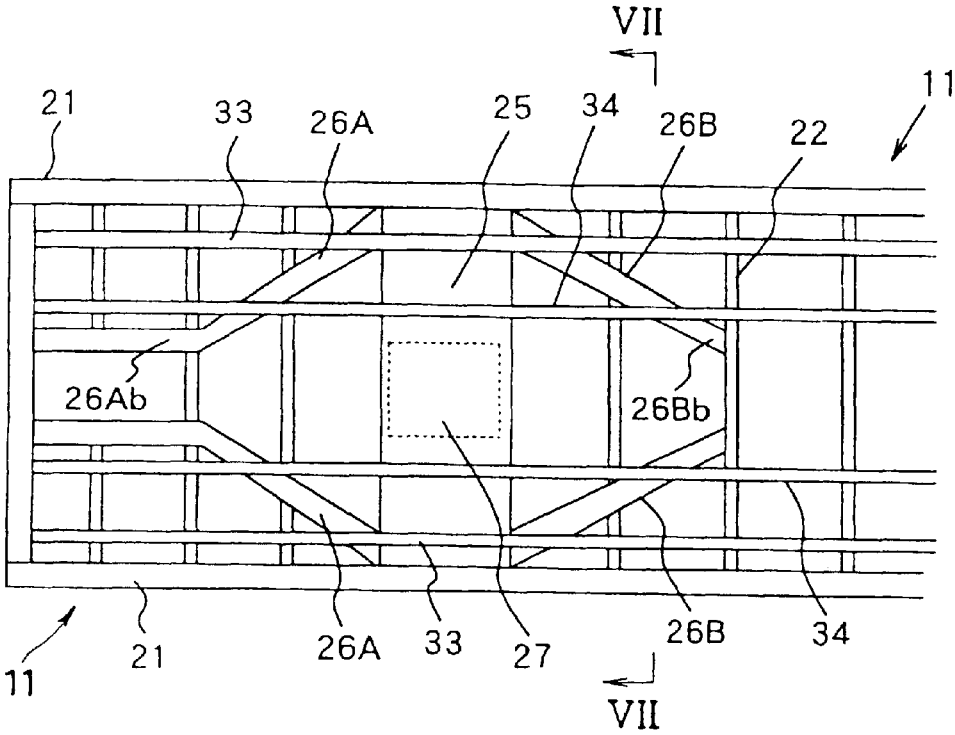
FIG. 6 is a plan view of the underframe according to another embodiment of the present invention.
Figure 7:
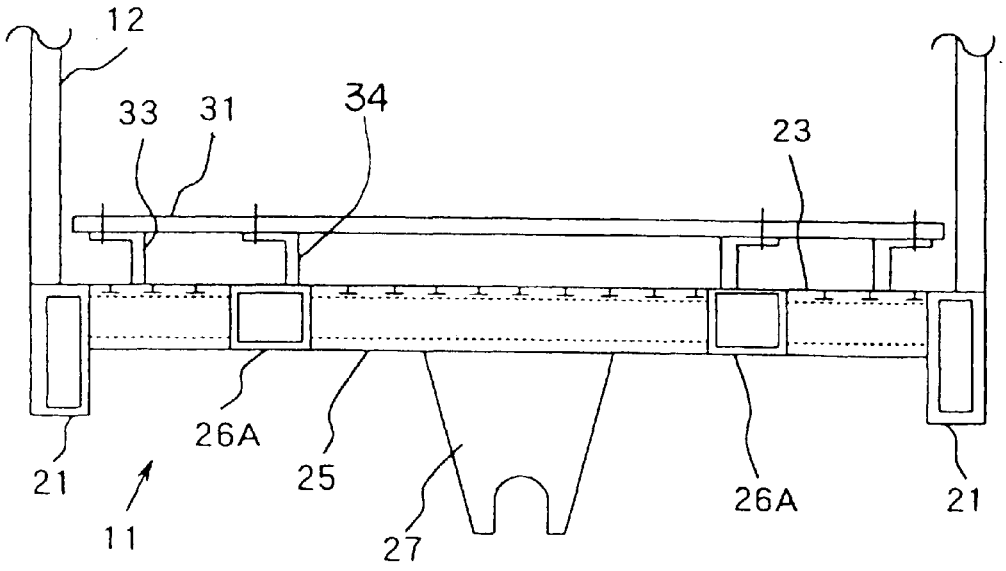
FIG. 7 is a cross-sectional view taken at VII—VII of FIG. 6.

The embodiment shown in FIGS. 6 and 7 will now be explained. The center sills 26A and 26B positioned in front of and behind the bolster 25 are tilted (slanted) in the longitudinal direction of the bolster 25. The center sills 26A and 26B are connected to the bolster 25 near the side sills 21. The other end portion 26Ab of the center sill 26A that is positioned beyond the bolster 25 toward the end of the car body is arranged closer to the width-direction-center of the underframe 11. The portion of the center sill that is positioned closer to the longitudinal end of the car body than the other end portion 26Ab can be positioned closer to the width-direction end of the car body. The other end portion 26Bb of the center sill 26B that is positioned closer to the center of the car body than the bolster 25 is arranged near the width-direction-center of the underframe 11. The slanted portions of the center sills 26A and 26B can have greater plate thickness or greater width than the other portions.

Common joists 33 and 34 for mounting the floor 31 of the passenger cabin 43 are positioned on the upper surface of the base plate 23. The common joists 33 and 34 are placed along the longitudinal direction of the car body. The two center common joists 34, 34 are positioned outward than the width-direction-end of the center pin 27 (width direction of the car body) at the joint portion between the center pin 27 and the bolster 25.

According to this arrangement, the vibration energy that is transmitted from the truck via the center pin 27, the bolster 25, the center sills 26A and 26B, the base plate 23, and common joists 33 and 34 to the floor 31 can be reduced. The vibration energy transmitted to the floor 31 via the common joists 34 is reduced since the common joists 34 near the center pin 27 through which the vibration energy is mostly transmitted are positioned outward than the center pin. Moreover, the center sills 26A and 26B are joined to the bolster 25 at the width-direction-end of the car body instead of being joined to the bolster 25 near the enter pin 27. This also reduces the vibration energy transmitted to the floor 31. Therefore, the noise (sound pressure) emitted to the passenger cabin caused by the vibration of the floor 31 is reduced. According to the above-mentioned embodiments, the present invention enables to reduce the noise within the car body of the railway car.

Figure 8:
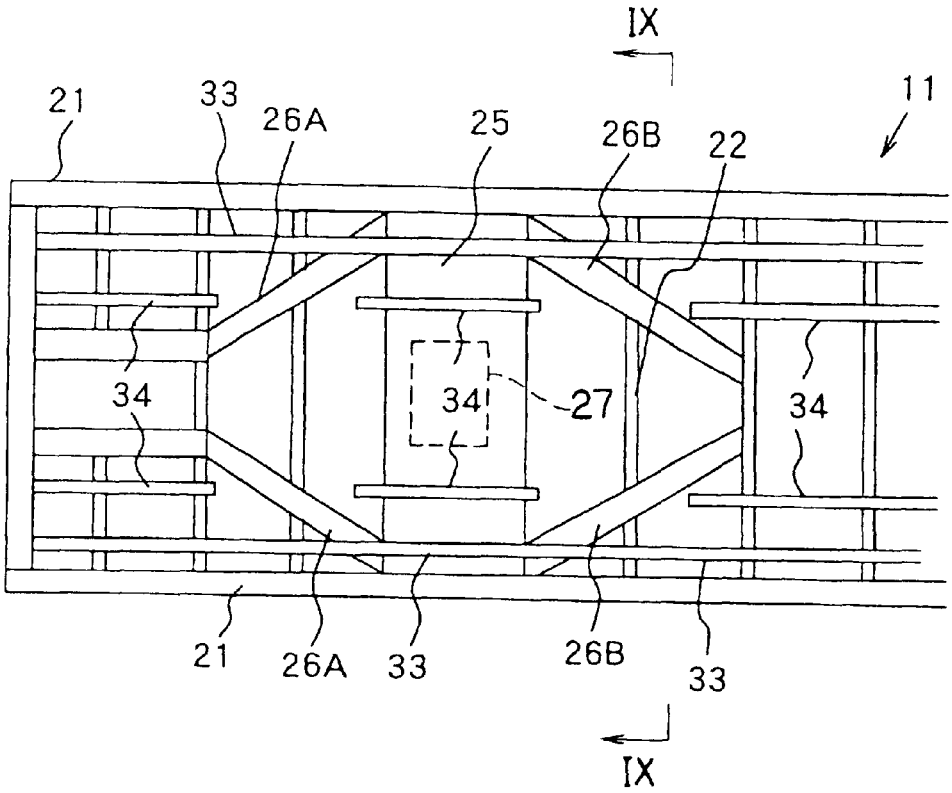
FIG. 8 is a plan view of the underframe according to another embodiment of the present invention.
Figure 9:
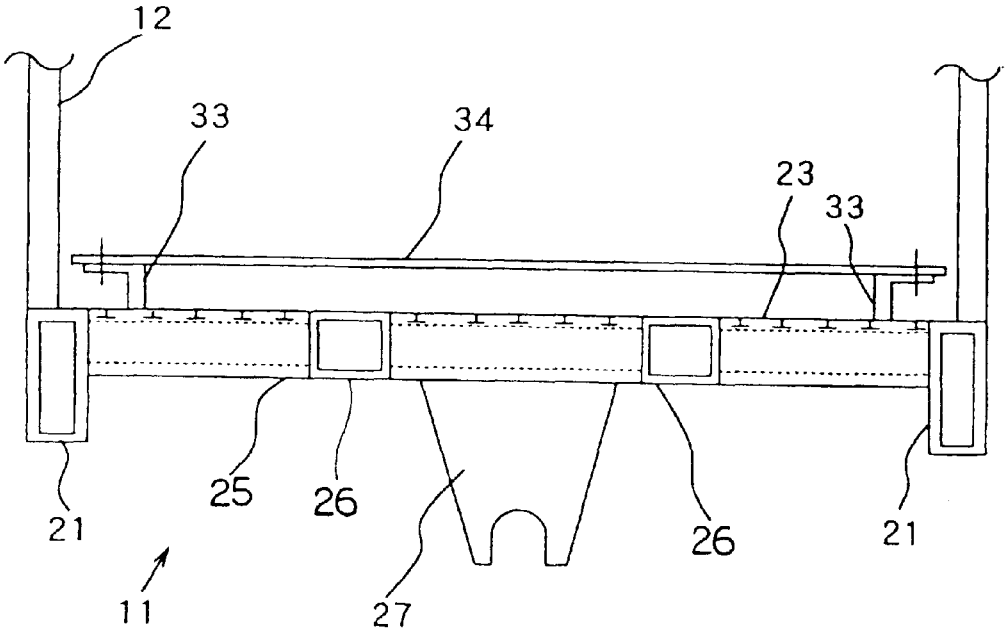
FIG. 9 is a cross-sectional view taken at IX—IX of FIG. 8.

The embodiment of FIGS. 8 and 9 is explained. The common joists 34, 34 are positioned on, (above) the bolster 25, but not in the area close to both ends of the bolster 25. In other words, each common joist 34 is discontinued in the longitudinal direction of the car body. This is because the common joists 34 are discontinued near the bolster 25 where vibration energy is most converged.

According to this arrangement, the area of the floor 31 where the common joists 34 do not exist is capable of isolating the vibration, so the sound pressure emitted in the passenger cabin by the vibration of the floor 31 at that particular area is reduced.

A cross bearer 22 is equipped in each of the embodiments explained above, but by forming the base plate 23 by a strong material, the bolster can be omitted.

According to the present invention, the noise within the passenger cabin of a railway car can be reduced.

We claim:

1. A railway car comprising:

two side sills, each of said side sills extending longitudinally along width-direction-ends of the railway car, a base plate mounted between said two side sills, a bolster positioned below said base plate between said two side sills, center sills connected to said bolster at the front and back ends of said bolster, plural common joists extending longitudinally and positioned above said base plate, and a floor of a passenger cabin mounted on said common joists, wherein in the area beyond said bolster toward the longitudinal end of said car body, the common joists exist near the width-direction-ends of the car body but do not exist near the center of width.

2. A railway car according to claim 1, wherein said railway car comprises the passenger cabin and a platform, and a partition board for dividing the passenger cabin and the platform is fixed to a frame member connected to said common joists positioned at the width-direction ends of the body.

3. A railway car according to claim 2, wherein the floor of said platform and the floor of said passenger cabin are made of different materials which are bordered on said partition board that divides said platform and said passenger cabin.

4. A railway car according to claim 1, wherein an air-conditioning duct is fixed onto the lower surface of the floor of said passenger cabin.

5. A railway car according to claim 1, wherein out of the plural common joists that are arranged along the longitudinal direction of the car body, the common joists positioned near the width-direction-center of the car body do not exist in the area near the front and back ends of said bolster.

6. A railway car according to claim 1, further comprising a plurality of transversely extending cross bearers spaced from one another in the longitudinal direction and connected to the cross beams, wherein the base plate is fixed to the cross bearers.

7. A railway car comprising:

two side sills, each of said side sills extending longitudinally along width-direction-ends of the railway car, a base plate mounted between said two side sills, a bolster positioned below said base plate between said two side sills, center sills connected to said bolster at the front and back ends of said bolster, plural common joists extending longitudinally and positioned above said base plate, and a floor of a passenger cabin mounted on said common joists, wherein, out of said plural common joists positioned along the longitudinal direction of the car body, the common joists positioned near the width-direction-center of said car body and mounted on the upper surface of said bolster are positioned closer to the width direction ends of the car body than the portion where the center pin is connected to the bolster.

8. A railway car according to claim 7, wherein said common joists positioned near the center area do not exist near the front and back ends of said bolster.

9. A railway car according to claim 7, further comprising a plurality of transversely extending cross bearers spaced from one another in the longitudinal direction and connected to the cross beams, wherein the base plate is fixed to the cross bearers.

10. A railway car comprising:

two side sills, each of said side sills extending longitudinally along width-direction-ends of the railway car, a base plate mounted between said two side sills, a bolster positioned below said base plate between said two side sills, center sills connected to the front and back ends of said bolster, plural common joists extending longitudinally and positioned above said base plate, and a floor of a passenger cabin mounted on said common joists, wherein each center sill is slanted at the portion extended between the bolster close to said cross beam and the width-direction-center of the car body.

11. A railway car according to claim 10, wherein out of the plural common joists positioned along the longitudinal direction of the car body, the common joists positioned near the width-direction-center of said car body are positioned closer to the width direction ends of the car body than the portion where the center pin is connected to the bolster.

12. A railway car according to claim 11, wherein the common joists positioned near the center do not exist near the front and back areas of said bolster.

13. A railway car according to claim 10, further comprising a plurality of transversely extending cross bearers spaced from one another in the longitudinal direction and connected to the cross beams, wherein the base plate is fixed to the cross bearers.

* * * * *